US011098556B2

(12) United States Patent
Frazier

(10) Patent No.: US 11,098,556 B2
(45) Date of Patent: Aug. 24, 2021

(54) DOWNHOLE ASSEMBLY FOR SELECTIVELY SEALING OFF A WELLBORE

(71) Applicant: Nine Energy Service, Inc., Houston, TX (US)

(72) Inventor: W. Lynn Frazier, Corpus Christi, TX (US)

(73) Assignee: Nine Energy Service, Inc., Houston, TX (US)

( * ) Notice: Subject to any disclaimer, the term of this patent is extended or adjusted under 35 U.S.C. 154(b) by 140 days.

(21) Appl. No.: 15/654,156

(22) Filed: Jul. 19, 2017

(65) Prior Publication Data

US 2017/0314363 A1 Nov. 2, 2017

Related U.S. Application Data

(63) Continuation of application No. 12/898,479, filed on Oct. 5, 2010, now Pat. No. 9,739,114, which is a (Continued)

(51) Int. Cl.

| | |
|---|---|
| ***E21B 34/06*** | (2006.01) |
| ***E21B 33/12*** | (2006.01) |
| ***E21B 33/129*** | (2006.01) |

(52) U.S. Cl.

CPC ..... *E21B 34/063* (2013.01); *E21B 33/1204* (2013.01); *E21B 33/1294* (2013.01)

(58) Field of Classification Search

CPC ..... E21B 34/063

See application file for complete search history.

(56) References Cited

U.S. PATENT DOCUMENTS 244,042 A 7/1881 Farrar
1,884,165 A * 10/1932 Otis ..... E21B 43/10 137/68.16

(Continued)

FOREIGN PATENT DOCUMENTS

CA 2148169 11/1995
CA 2469251 7/2003

(Continued)

OTHER PUBLICATIONS

Society of Petroleum Engineers Inc., SPE 88738, Implementations of New Technologies for Oil and Gas industry Moh'd Mamdouh Shaker, et al., 8 pages. Oct. 10, 2004.

(Continued)

*Primary Examiner* — Blake E Michener
(74) *Attorney, Agent, or Firm* — Jackson Walker LLP

(57) ABSTRACT

Downhole assemblies and methods for isolating a wellbore. A downhole tool can include a body having a bore or flowpath formed therethrough, and one or more sealing members disposed therein. The one or more sealing members can include an annular base and a curved surface having an upper face and a lower face, wherein one or more first radii define the upper face, and one or more second radii define the lower face, and wherein, at any point on the curved surface, the first radius is greater than the second radius. The sealing members can be disposed within the bore of the tool using one or more annular sealing devices disposed about the one or more sealing members.

26 Claims, 5 Drawing Sheets

Related U.S. Application Data continuation of application No. 11/949,629, filed on Dec. 3, 2007, now Pat. No. 7,806,189.

(56) References Cited

U.S. PATENT DOCUMENTS 2,008,818 A 7/1935 Corbett
2,117,318 A 5/1938 Hanes
2,565,731 A 8/1951 Luther
2,756,828 A * 7/1956 Deily ..... E21B 37/08 166/147
3,015,469 A 1/1962 Falk
3,207,184 A 9/1965 Lambert
3,406,864 A 10/1968 Schmidt
3,467,271 A 9/1969 Clem
3,533,241 A * 10/1970 Richardson ..... E02B 17/0013 138/89
3,599,713 A 8/1971 Jenkins
3,831,680 A * 8/1974 Edwards ..... E21B 21/10 166/311
3,980,134 A 9/1976 Amancharia
4,211,280 A 7/1980 Yeates
4,218,299 A 8/1980 Lindell et al.
4,510,994 A 4/1985 Pringle
4,512,491 A 4/1985 DeGood et al.
4,541,484 A 9/1985 Salemi et al.
4,553,559 A 11/1985 Short
4,605,074 A 8/1986 Barfield
4,609,005 A 9/1986 Upchurch
4,658,902 A * 4/1987 Wesson ..... E21B 34/063 166/317
4,664,184 A 5/1987 Grigar
4,683,943 A 8/1987 Hill et al.
4,683,956 A 8/1987 Russell
4,691,775 A 9/1987 Lustig et al.
4,739,799 A 4/1988 Carney et al.
4,813,481 A 3/1989 Sproul et al.
4,901,802 A 2/1990 George et al.
4,969,524 A 11/1990 Whiteley
5,012,867 A 5/1991 Kilgore
5,050,630 A 9/1991 Farwell et al.
5,117,915 A 6/1992 Mueller et al.
5,145,005 A 9/1992 Dollison
5,188,182 A 2/1993 Echols
5,281,270 A 1/1994 Totien et al.
5,479,986 A * 1/1996 Gano ..... E21B 23/00 166/292
5,511,617 A 4/1996 Snider et al.
5,607,017 A 3/1997 Owens et al.
5,685,372 A * 11/1997 Gano ..... E21B 23/00 166/292
5,765,641 A 6/1998 Shy et al.
5,829,526 A 11/1998 Rogers et al.
5,924,696 A * 7/1999 Frazier ..... E21B 34/063 138/90
5,947,204 A * 9/1999 Barton ..... E21B 33/1295 166/317
5,996,696 A 12/1999 Jefferee et al.
6,026,903 A * 2/2000 Shy ..... E21B 23/00 166/192
6,076,600 A 6/2000 Vick et al.
6,155,350 A 12/2000 Melenyzer
6,220,350 B1 4/2001 Brothers et al.
6,334,488 B1 1/2002 Freiheit
6,397,950 B1 6/2002 Stretch et al.
6,472,068 B1 10/2002 Glass et al.
6,561,275 B2 5/2003 Glass et al.
6,634,430 B2 10/2003 Dawson et al.
6,672,389 B1 1/2004 Hinrichs
6,799,634 B2 10/2004 Hartog et al.
7,044,230 B2 5/2006 Starr
7,090,027 B1 8/2006 Williams
7,117,946 B2 10/2006 Herr
7,168,494 B2 1/2007 Starr
7,210,533 B2 5/2007 Starr
7,287,596 B2 10/2007 Frazier
7,350,582 B2 4/2008 McKeachnie et al.
7,455,116 B2 11/2008 Lembcke
7,533,721 B2 5/2009 Sorhus
7,624,796 B2 12/2009 Hassel-Sorensen
7,640,984 B2 1/2010 Vert et al.
7,661,480 B2 2/2010 Al-Anazi
7,708,066 B2 5/2010 Frazier
7,757,764 B2 7/2010 Vert et al.
7,789,162 B2 9/2010 Keller
7,798,236 B2 9/2010 McKeachnie
7,806,189 B2 10/2010 Frazier
7,950,409 B2 5/2011 Stokes et al.
7,963,340 B2 6/2011 Gramstad et al.
7,963,342 B2 6/2011 George
8,157,012 B2 4/2012 Frazier
8,424,605 B1 4/2013 Schultz et al.
8,813,848 B2 8/2014 Frazier
8,820,437 B2 9/2014 Ervin
8,833,154 B2 9/2014 Skillingstad
9,149,209 B2 11/2015 Frazier
9,217,319 B2 12/2015 Frazier et al.
9,291,031 B2 3/2016 Frazier
9,382,778 B2 7/2016 Frazier
9,500,061 B2 11/2016 Frazier et al.
9,506,309 B2 11/2016 Frazier et al.
9,540,904 B2 1/2017 Petrowsky
9,739,114 B2 8/2017 Frazier
10,107,070 B2 * 10/2018 Yong ..... E21B 34/063
10,184,316 B2 1/2019 Perez et al.
10,208,564 B2 * 2/2019 Ravensbergen ..... E21B 17/00
10,316,979 B2 6/2019 Petrowsky
10,458,201 B2 10/2019 Frazier
10,465,445 B2 11/2019 Getzlaf
10,465,468 B2 11/2019 Frazier et al.
2001/0022194 A1 9/2001 Davis et al.
2003/0127224 A1 7/2003 Vick, Jr. et al.
2003/0168214 A1 9/2003 Sollesnes
2006/0048936 A1 3/2006 Fripp et al.
2007/0215361 A1 9/2007 Pia
2007/0246211 A1 10/2007 Schneider et al.
2007/0251698 A1 * 11/2007 Gramstad ..... E21B 34/063 166/376
2007/0284119 A1 12/2007 Jackson
2008/0078553 A1 * 4/2008 George ..... E21B 34/063 166/332.8
2008/0115942 A1 5/2008 Keller et al.
2008/0156498 A1 7/2008 Phi
2008/0271898 A1 11/2008 Turley
2009/0020290 A1 1/2009 Ross
2009/0056955 A1 3/2009 Slack
2011/0253387 A1 10/2011 Ervin
2011/0284242 A1 * 11/2011 Frazier ..... E21B 34/063 166/376
2011/0284243 A1 * 11/2011 Frazier ..... E21B 34/063 166/376
2011/0315398 A1 12/2011 Ueland
2012/0125631 A1 5/2012 Entchev et al.
2012/0305267 A1 12/2012 Steele
2014/0008085 A1 1/2014 Tinnen
2014/0190685 A1 7/2014 Frazier et al.
2014/0216756 A1 * 8/2014 Getzlaf ..... E21B 33/14 166/376
2015/0068730 A1 3/2015 Frazier
2016/0281455 A1 9/2016 Brandsdal et al.
2017/0138153 A1 5/2017 Getzlaf et al.
2017/0284167 A1 10/2017 Takahashi et al.
2017/0314363 A1 11/2017 Frazier
2017/0370182 A1 12/2017 Provost
2018/0156007 A1 6/2018 Petrowsky
2018/0324026 A1 11/2018 Yong
2018/0334878 A1 11/2018 Hiorth
2018/0371869 A1 12/2018 Kellner et al.
2019/0106983 A1 4/2019 Elbadawy
2019/0136666 A1 5/2019 Kent
2019/0234180 A1 8/2019 Frazier
2019/0352995 A1 11/2019 Giroux et al.

(56) References Cited

U.S. PATENT DOCUMENTS

FOREIGN PATENT DOCUMENTS

| | | | |
|---|---|---|---|
| CA | 2587395 | | 6/2005 |
| CA | 2670218 | | 12/2010 |
| CA | 3043410 | | 11/2019 |
| GB | 688727 | | 3/1953 |
| GB | 2437657 | | 10/2007 |
| WO | 1991012451 | A1 | 8/1991 |
| WO | 2003052239 | A1 | 6/2003 |
| WO | 2009116871 | A1 | 9/2009 |

OTHER PUBLICATIONS

Society of Petroleum Engineers Inc., SPE/IADC 148541, Buoyancy Technology Used Effectively in Casing Running Operations to Extend Lateral Stepout: Two Case Histories Detail Application Risks and Successes; Hank Rogers, et al., 12 pages. Oct. 24, 2011.
Society of Petroleum Engineers Inc., SPE/IADC 119373, Increasing Sakhalin Extended Reach Drilling and Completion Capability; Michael W. Walker, et al., 14 pages. Mar. 17, 2009.
Oilfield Review, Extended-Reach Drilling: Breaking the 10-km Barrier; Frank Allen, et al., 16 pages. Dec. 31, 1997.
Society of Petroleum engineers Inc., SPE 23/41, Mechanical Fluid Loss Control Systems Used During Sand Control Operations; H.L. Restarick, 11 pages. Mar. 8, 1992.
Society of Petroleum Engineers Inc., SPE/IADC 105839, Floatation of 10 3/4-in. Liner-A Method Used To Reach Beyond 10 km; Johan Eck-Olsen, et al., 9 pages. Feb. 22, 2007.
Owen Oil Tools, Surge Tool, Underbalance Sub, TC-090-0.4, 1 page. Jun. 30, 2002.
Non-Final Office Action, List of References by Examiner, dated Apr. 30, 2020, U.S. Appl. No. 16/810,395, 20 pages dated Apr. 30, 2020.
500 x 300 TDP-PO Plug, 3 1/2"-9.2# JFE BEAR PINxPIN, Drawing No. 2005021, TCO AS, 1 page. Jul. 30, 2012.
572 x 375 TDP-PO Plug, Drawing No. 1018-12-001, TCO AS, 1 page Sep. 5, 2011.
SPE/IADC 148541, Buoyance Technology Used Effectively in Casing Running Operations To Extend Lateral Stepout: Two Case Histories Detail Application Risks and Successes, Hank Rogers, et al., 12 pages Oct. 24, 2011.
Petition For Post-Grant Review of U.S. Pat. No. 10,465,445, *TCI AS* v. *NCS Multistage Inc.*, USPTO, PTAB, Case PGR2020-00078, 126 pages dated Aug. 5, 2020.
IADC/SPE 99131, The Next Generation of Sakhalin Extended-Reach Drilling, R.A. Viktorin, et al., 9 pages. Feb. 21, 2006.
Core Lab, Owen Oil Tools, Magnum Ported Underbalance Sub, Supplied by Magnum Oil Tools, copyright 2007 Owen Oil Tools, Last Revised Sep. 2012, MAG-01 .MUDA.278.8EBP, 01 .MSRK. 278.9999, 2 pages. Sep. 30, 2012.
Magnum Oil Tools International, Oil and Gas Online, "Single MagnumDisk", Jun. 21, 2011, 2 pages Jun. 21, 2011.
Core Lab, Own Oil Tools, Technical Information: Differential Plug, TC-82 (R01), Copyright 2007, Owen Oil Tools, www.corelab.com/owen, 3 pages Dec. 1, 2007.
Core Lab, Owen Oil Tools, Surge Tool, Ported Underbalance Sub, TC-091-2375-200 & 000, TC-091-2875-200 & 000, Revised Jun. 2002, TC-091-0.3, TC-091-04, TC-091-0.5, 3 pages Jun. 30, 2002.
Core Lab Reservoir Optimization, Owen Oil Tools, Surge Tool, Underbalance Sub, TC-090-2375-200 & 000, TC-090-2875-200 & 000, Revised Jun. 2002, Copyright 2004 Owen Oil Tools, TC-090-0.3, TC-090-04, TC-090-0.5, 3 pages Jun. 30, 2002.
Core Lab Reservoir Optimization, Owen Oil Tools, Drop Bar, Slim Nose, TC-130, Drop Bar, Slim Nose Brass Button, TC-132, Revised Jun. 2007, Copyright 2004 Owen Oil Tools, TC-130-0.3, TC-130-OA, 2 pages Jun. 30, 2007.
H. E. Rogers, D. L. Bolado, and B. L. Sulla Way, "Buoyance Assist Extends Casing Reach in Horizontal Wells", SPE 50680, Copyright 1998, Society of Petroleum Engineers, Inc., Prepared for presentation at the 1998 European Jetroleum Conference in Theh Hague, Oct. 20-22, 1998, 8 pages Oct. 20, 1998.

* cited by examiner

DOWNHOLE ASSEMBLY FOR SELECTIVELY SEALING OFF A WELLBORE

CROSS-REFERENCE TO RELATED APPLICATIONS

This application is a continuation of U.S. patent application Ser. No. 12/898,479, filed Oct. 5, 2010, which is a continuation of U.S. patent application Ser. No. 11/949,629, filed on Dec. 3, 2007, and now issued as U.S. Pat. No. 7,806,189. Both of these prior applications are incorporated by reference herein in the entirety.

BACKGROUND

Field of the Invention

Embodiments of the present invention generally relate to downhole tools. More particularly, embodiments relate to a downhole tool having one or more frangible and/or decomposable disks for sealing off a wellbore.

Description of the Related Art

Bridge plugs ("plugs") and packers are typically used to permanently or temporarily isolate two or more zones within a wellbore. Such isolation is often necessary to pressure test, perforate, frac or stimulate a section of the well without impacting or communicating with other zones within the wellbore. After completing the task requiring isolation, the plugs and/or packers are removed or otherwise compromised to reopen the wellbore and restore fluid communication from all zones both above and below the plug and/or packer.

Permanent (i.e. non-retrievable) plugs are typically drilled or milled to remove. Most non-retrievable plugs are constructed of a brittle material such as cast iron, cast aluminum, ceramics or engineered composite materials which can be drilled or milled. However, problems sometimes occur during the removal of non-retrievable plugs. For instance, without some sort of locking mechanism to hold the plug within the wellbore, the permanent plug components can bind upon the drill bit, and rotate within the casing string. Such binding can result in extremely long drill-out times, excessive casing wear, or both. Long drill-out times are highly undesirable as rig time is typically charged by the hour.

Retrievable plugs typically have anchors and sealing elements to securely anchor the plug within the wellbore in addition to a retrieving mechanism to remove the plug from the wellbore. A retrieval tool is lowered into the wellbore to engage the retrieving mechanism on the plug. When the retrieving mechanism is actuated, the slips and sealing elements on the plug are retracted, permitting withdrawal of the plug from the wellbore. A common problem with retrievable plugs is that accumulation of debris on the top of the plug may make it difficult or impossible to engage the retrieving mechanism. Debris within the well can also adversely affect the movement of the slips and/or sealing elements, thereby permitting only partial disengagement from the wellbore. Additionally, the jarring of the plug or friction between the plug and the wellbore can unexpectedly unlatch the retrieving tool, or relock the anchoring components of the plug. Difficulties in removing a retrievable bridge plug sometimes require that a retrievable plug be drilled or milled to remove the plug from the wellbore.

Other plugs have employed sealing disks partially or wholly fabricated from brittle materials that can be physically fractured by dropping a weighted bar via wireline into the casing string to fracture the sealing disks. While permitting rapid and efficient removal within vertical wellbores, weighted bars are ineffective at removing sealing solutions in deviated, or horizontal wellbores. On occasion, the physical destruction of the sealing disks do not restore the full diameter of the wellbore as fragments created by the impact of the weighted bar may remain lodged within the plug or the wellbore. The increased pressure drop and reduction in flow through the wellbore caused by the less than complete removal of the sealing disks can result in lost time and increased costs incurred in drilling or milling the entire sealing plug from the wellbore to restore full fluid communication. Even where physical fracturing of the sealing disks restores full fluid communication within the wellbore, the residual debris generated by fracturing the sealing disks can accumulate within the wellbore, potentially interfering with future downhole operations.

There is a need, therefore, for a sealing solution that can effectively seal the wellbore, withstand high differential pressures, and quickly, easily and reliably removed from the wellbore without generating debris or otherwise restricting fluid communication through the wellbore.

SUMMARY

Downhole tools and methods for isolating a wellbore. A downhole tool can include a body having a bore or flowpath formed therethrough, and one or more sealing members disposed therein. The one or more sealing members can include an annular base and a curved surface having an upper face and a lower face, wherein one or more first radii define the upper face, and one or more second radii define the lower face, and wherein, at any point on the curved surface, the first radius is greater than the second radius. The sealing members can be disposed within the bore of the tool using one or more annular sealing devices disposed about the one or more sealing members.

BRIEF DESCRIPTION OF THE DRAWINGS

So that the manner in which the above recited features of the present invention can be understood in detail, a more particular description of the invention, briefly summarized above, can be had by reference to embodiments, some of which are illustrated in the appended drawings. It is to be noted, however, that the appended drawings illustrate only typical embodiments of this invention and are therefore not to be considered limiting of its scope, for the invention can admit to other equally effective embodiments.

DETAILED DESCRIPTION

A detailed description will now be provided. Each of the appended claims defines a separate invention, which for infringement purposes is recognized as including equivalents to the various elements or limitations specified in the claims. Depending on the context, all references below to the "invention" can in some cases refer to certain specific embodiments only. In other cases it will be recognized that references to the "invention" will refer to subject matter recited in one or more, but not necessarily all, of the claims. Each of the inventions will now be described in greater detail below, including specific embodiments, versions and examples, but the inventions are not limited to these embodiments, versions or examples, which are included to enable a person having ordinary skill in the art to make and use the inventions, when the information in this patent is combined with available information and technology.

Figure 1:
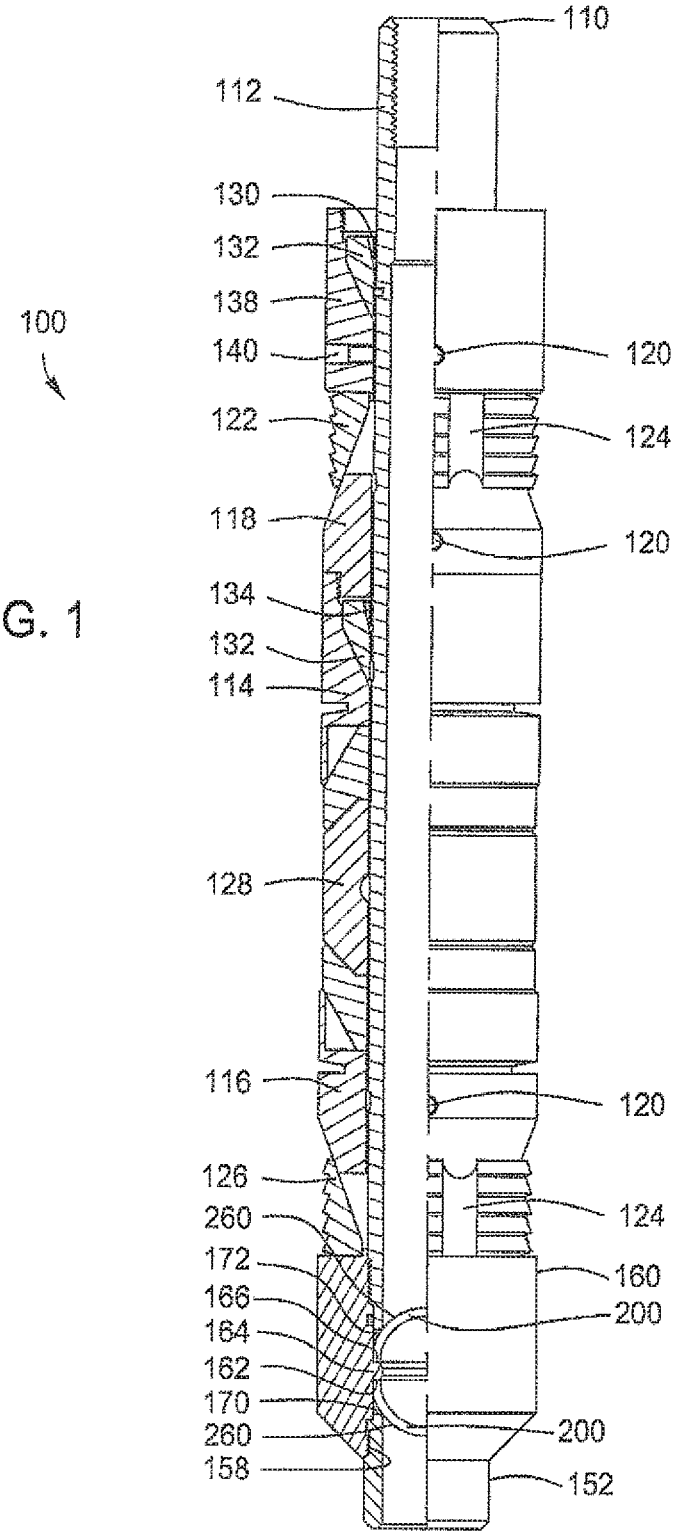
FIG. 1 depicts a partial sectional view of an illustrative tool having one or more sealing members in accordance with one or more embodiments described.

FIG. 1 depicts a partial sectional view of an illustrative tool having one or more sealing members in accordance with one or more embodiments. The tool 100 can include two or more threadably connected sections (three are shown, a plug section 110, a valve section 160, and a bottom sub-assembly ("bottom-sub") 152), each having a bore formed therethrough. The plug section 110, valve section 160 and bottom-sub 152 can be threadably interconnected as depicted in FIG. 1, or arranged in any order or configuration. Preferably, the plug section 110, valve section 160 and bottom-sub 152 are constructed from a metallic or composite material. As used herein, the terms "connect," "connection," "connected," "in connection with," an "connecting" refer to "in direct connection with" or "in connection with via another element or member."

The valve section 160 can include one or more sealing members 200 disposed therein. The sealing members 200 can be disposed transversally to a longitudinal axis of the tool 100, preventing fluid communication through the bore of the tool 100. A first end of the one or more sealing members 200 can be curved or domed. The curved configuration can provide greater pressure resistance than a comparable flat surface. In one or more embodiments, a first ("lower") sealing member 200 can be oriented with the curvature facing downward to provide greater pressure resistance to upward flow through the tool 100. In one or more embodiments, a second ("upper") sealing member 200 can be oriented with the curvature in a second direction ("upward") to provide greater pressure resistance in a first direction ("downward") through the tool 100.

The terms "up" and "down"; "upper" and "lower"; "upwardly" and "downwardly"; "upstream" and "downstream"; "above" and "below"; and other like terms as used herein refer to relative positions to one another and are not intended to denote a particular direction or spatial orientation.

Figure 2A:
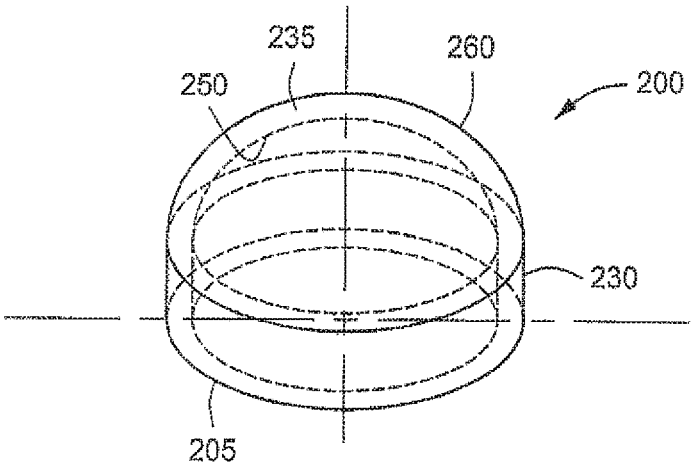
FIG. 2A depicts a 45° upper orthogonal view of an illustrative sealing member according to one or more embodiments described.
Figure 2B:
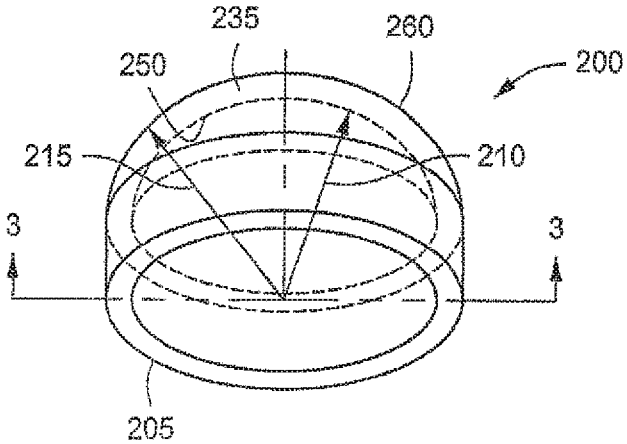
FIG. 2B depicts a 45° lower orthogonal view of the illustrative sealing member shown in FIG. 2A, according to one or more embodiments described.

FIG. 2A depicts a 45° upper orthogonal view of an illustrative sealing member 200 according to one or more embodiments, and FIG. 2B depicts a 45° lower orthogonal view of the sealing member 200 according to one or more embodiments. The sealing member 200 can have at least one closed end that is curved or dished. For example, the disk 200 can include a base 230 having a domed or curved section 235 disposed thereon. The base 230 can be annular, and can include an edge or end 205 that is opposite the curved surfaces 250, 260. The end 205 can be rounded or chamfered. The curved section 235 can include an inner curved surface 250 that is concave relative to the base 230 and an outer curved surface 260 that is convex relative the base 230. In one or more embodiments, one or more external radii 215 can define the convex, curved surface 260 and one or more interior radii 210 can define a concave surface 250, as depicted more clearly in FIG. 3.

Figure 3:
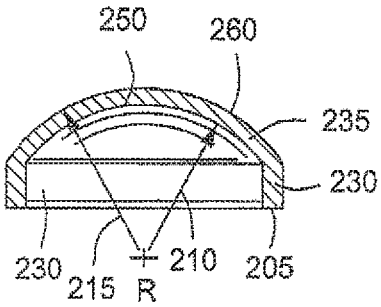
FIG. 3 depicts an illustrative cross section along line 3-3 of FIG. 2B.

FIG. 3 depicts an illustrative cross section along line 3-3 of FIG. 2B. FIG. 3 more clearly shows the spatial relationship between the curved section 235, surfaces 250, 260, base 230, and edge 205. In one or more embodiments, the internal radius 210 and the external radius 215 can be selected to provide maximum strength to forces normal to tangential to the curved surface 260 of the sealing member 200. For example, the external radius 215 can be about 0.500× the inside diameter of the adjoining tool body 140 ($ID_{TS}$) to about 2.000×$ID_{TS}$, about 0.500×$ID_{TS}$ to about 1.500×$ID_{TS}$, or about 0.500×$ID_{TS}$ to about 1.450×$ID_{TS}$. In one or more embodiments, the base 230 can have a height, measured as the distance from the edge 205 to the curved section 235, of about 0.05×$ID_{TS}$ to about 0.20×$ID_{TS}$, about 0.05×$ID_{TS}$ to about 0.15×$ID_{TS}$, or about 0.05×$ID_{TS}$ to about 0.10×$ID_{TS}$.

The sealing member 200 can be made from any process compatible material. In one or more embodiments, the sealing member 200 can be frangible. For example, the sealing member 200 can be constructed of a ceramic material. In one or more embodiments, the sealing member 200 can be constructed of a ceramic, engineered plastic, carbon fiber, epoxy, fiberglass, or any combination thereof.

In one or more embodiments, the sealing member 200 can be partially or completely soluble. For example, the sealing member 200 can fabricated from a material at least partially soluble or decomposable in water, polar solvents, non-polar solvents, acidic solutions, basic solutions, mixtures thereof and/or combinations thereof.

In one or more embodiments, at least a portion of the sealing member 200 can be soluble and/or frangible, i.e. fabricated from two or more materials. For example, the base 230 can be fabricated from any frangible material described and the domed, upper section 235 can be fabricated from any soluble material described, such as a material soluble in methanol and/or ethanol. Such an arrangement would be advantageous where a soluble sealing member 200 is desired, but a resilient seating surface 230 is required to withstand downhole conditions. Likewise, the base 230 can be fabricated from any soluble material described and the domed, upper section 235 can be fabricated from any frangible material.

In one or more embodiments, the soluble or decomposable portions of the one or more sealing members 200 can be degraded using one or more time dependent solvents. A time dependent solvent can be selected based on its rate of degradation. For example, suitable solvents can include one or more solvents capable of degrading the disk 200 in about 30 minutes, 1 hour, 3 hours, 8 hours or 12 hours to about 2 hours, 4 hours, 8 hours, 24 hours or 48 hours.

Considering the valve section 160 in greater detail, a first end and a second end of the valve section 160 can define a threaded, annular, cross-section, which can permit threaded attachment of the valve section 160 to a lower sub-assembly ("bottom-sub") 152, a casing string, and/or to other tubulars. As depicted in FIG. 1, the first, downward facing, sealing member 200 and the second, upward facing, sealing member 200 can be disposed transverse to the longitudinal axis of the valve section 160 to prevent bi-directional fluid communication and/or pressure transmission through the tool 100. In one or more embodiments, the valve section 160 can include an annular shoulder 164 disposed circumferentially about an inner diameter thereof. The shoulder 164 can include a downward facing sealing member seating surface ("first surface") 162 and an upward facing sealing member seating surface ("second surface") 166 projecting from the inner diameter of the valve section 160. The shoulder 164 can be chamfered or squared to provide fluid-tight contact with the end 205 of the sealing member 200.

In one or more embodiments, the first, downward facing, sealing member 200 can be concentrically disposed transverse to the longitudinal axis of the tool 100 with the end 205 proximate to the downward facing first surface 162 of the shoulder 164. A second, upwardly facing, sealing member 200 can be similarly disposed with the end 205 proximate to the upward facing second surface 166 of the shoulder 164. A circumferential sealing device ("first crush seal") 170 can be disposed about a circumference of the curved surface 260 of the first, downwardly facing, sealing member 200. As a second (upper) end of the bottom-sub 152 is threadably engaged to a first (lower) end of the valve section 160, the first crush seal 170 can be compressed between the upper end of the bottom-sub 152, the valve section 160 and the sealing member 200, forming a liquid-tight seal therebetween. The pressure exerted by the bottom-sub 152 on the sealing member 200 causes the end 205 of the sealing member 200 to seat against the first surface 162.

Similarly, a circumferential sealing device ("second crush seal") 172 can be disposed about the curved surface 260 of the second, upwardly facing, sealing member 200. As a first (lower) end of the plug section 110 is threadably engaged to a second (upper) end of the valve section 160, the second crush seal 172 can be compressed between the lower end of the plug section 110, the valve section 160 and the second sealing member 200, forming a liquid-tight seal therebetween. The pressure exerted by the plug section 110 on the sealing member 200 causes the end 205 of the sealing member 200 to seat against the second surface 166.

In one or more embodiments, the first and second crush seals, 170 and 172 can be fabricated from any resilient material unaffected by downhole stimulation and/or production fluids. Such fluids can include, but are not limited to, frac fluids, proppant slurries, drilling muds, hydrocarbons, and the like. For example, the first and second crush seals 170, 172 can be fabricated from the same or different materials, including, but not limited to, buna rubber, polytetrafluoroethylene ("PTFE"), ethylene propylene diene monomer ("EPDM"), Viton®, or any combination thereof.

The plug section 110 can include a mandrel ("body") 112, first and second back-up ring members 114, 116, first and second slip members 122, 126, element system 128, first and second lock rings 118, 134, and support rings 138. Each of the members, rings and elements 114, 116, 122, 126, 128, 130, and 134 can be disposed about the body 112. One or more of the body, members, rings, and elements 112, 114, 116, 122, 126, 128, 130, 134, 138 can be constructed of a non-metallic material, preferably a composite material, and more preferably a composite material described herein. In one or more embodiments, each of the members, rings and elements 114, 116, 122, 126, 128, and 138 are constructed of a non-metallic material. The plug section 110 can include a non-metallic sealing system 134 disposed about a metal or more preferably, a non-metallic mandrel or body 122.

The backup ring members 114, 116 can be and are preferably constructed of one or more non-metallic materials. In one or more embodiments, the backup ring members 114, 116 can be one or more annular members with a first section having a first diameter stepping up to a second section having a second diameter. A recessed groove or void can be disposed or defined between the first and second sections. The groove or void in the back up ring members 114, 116 permits expansion of the ring member.

The backup ring members 114, 116 can be one or more separate components. In one or more embodiments, at least one end of the ring member 114, 116 is conical shaped or otherwise sloped to provide a tapered surface thereon. In one or more embodiments, the tapered portion of the ring members 114, 116 can be a separate cone 118 disposed on the ring member 114, 116 having wedges disposed thereon. The cone 118 can be secured to the body 110 by a plurality of shearable members such as screws or pins (not shown) disposed through one or more receptacles 120.

In one or more embodiments, the cone 118 or tapered member can include a sloped surface adapted to rest underneath a complimentary sloped inner surface of the slip members 122, 126. As will be explained in more detail below, the slip members 122, 126 can travel about the surface of the cone 118 or ring member 116, thereby expanding radially outward from the body 110 to engage the inner surface of the surrounding tubular or borehole.

Each slip member 122, 126 can include a tapered inner surface conforming to the first end of the cone 118 or sloped section of the ring member 116. An outer surface of the slip member 122, 126 can include at least one outwardly extending serration or edged tooth, to engage an inner surface of a surrounding tubular (not shown) if the slip member 122, 126 moves radially outward from the body 112 due to the axial movement across the cone 118 or sloped section of the ring member 116.

The slip member 122, 126 can be designed to fracture with radial stress. In one or more embodiments, the slip member 122, 126 can include at least one recessed groove 124 milled therein to fracture under stress allowing the slip member 122, 126 to expand outwards to engage an inner surface of the surrounding tubular or borehole. For example, the slip member 122, 126 can include two or more, preferably four, sloped segments separated by equally spaced recessed longitudinal grooves 124 to contact the surrounding tubular or borehole, which become evenly distributed about the outer surface of the body 112.

The element system 128 can be one or more components. Three separate components are shown in FIG. 1. The element system 128 can be constructed of any one or more malleable materials capable of expanding and sealing an annulus within the wellbore. The element system 128 is preferably constructed of one or more synthetic materials capable of withstanding high temperatures and pressures. For example, the element system 128 can be constructed of a material capable of withstanding temperatures up to 450° F., and pressure differentials up to 15,000 psi. Illustrative materials include elastomers, rubbers, Teflon®, blend and combinations thereof.

In one or more embodiments, the element system 128 can have any number of configurations to effectively seal the annulus. For example, the element system 128 can include one or more grooves, ridges, indentations, or protrusions designed to allow the element system 128 to conform to variations in the shape of the interior of a surrounding tubular or borehole.

The support ring 138 can be disposed about the body 112 adjacent a first end of the slip 122. The support ring 138 can be an annular member having a first end that is substantially flat. The first end serves as a shoulder adapted to abut a setting tool described below. The support ring 138 can include a second end adapted to abuts the slip 122 and transmit axial forces therethrough. A plurality of pins can be inserted through receptacles 141 to secure the support ring 138 to the body 112.

In one or more embodiments, two or more lock rings 130, 134 can be disposed about the body 112. In one or more embodiments, the lock rings 130, 134 can be split or "C" shaped allowing axial forces to compress the rings 130, 134 against the outer diameter of the body 112 and hold the rings 130, 134 and surrounding components in place. In one or more embodiments, the lock rings 130, 134 can include one or more serrated members or teeth that are adapted to engage the outer diameter of the body 112. Preferably, the lock rings 130, 134 are constructed of a harder material relative to that of the body 110 so that the rings 130, 134 can bite into the outer diameter of the body 112. For example, the rings 130, 134 can be made of steel and the body 112 made of aluminum.

In one or more embodiments, one or more of the first lock rings 130, 132 can be disposed within a lock ring housing 132. The first lock ring 130 is shown in FIG. 1 disposed within the housing 132. The lock ring housing 132 has a conical or tapered inner diameter that complements the tapered angle on the outer diameter of the lock ring 130. Accordingly, axial forces in conjunction with the tapered outer diameter of the lock ring housing 130 urge the lock ring 130 towards the body 112.

In operation, the plug 100 can be installed in a wellbore using a non-rigid system, such as an electric wireline or coiled tubing. Any commercial setting tool adapted to engage the upper end of the plug 100 can be used. Specifically, an outer movable portion of the setting tool can be disposed about the outer diameter of the support ring 138. An inner portion of the setting tool can be fastened about the outer diameter of the body 112. The setting tool and plug 100 are then run into the wellbore to the desired depth where the plug 100 is to be installed.

To set or activate the plug 100, the body 112 can be held by the wireline, through the inner portion of the setting tool, while an axial force can be applied through a setting tool to the support ring 138. The axial force causes the outer portions of the plug 100 to move axially relative to the body 112. The downward axial force asserted against the support ring 138 and the upward axial force on the body 110 translates the forces to the moveable disposed slip members 122, 126 and back up ring members 114, 116. The slip members 122, 126 are displaced up and across the tapered surfaces of the backup ring members 114, 116 or separate cone 118 and contact an inner surface of a surrounding tubular. The axial and radial forces are applied to the slip members 122, 126 causing the recessed grooves 124 in the slip members 122, 126 to fracture, permitting the serrations or teeth of the slip members 122, 126 to firmly engage the inner surface of the surrounding tubular.

The opposing forces cause the back-up ring members 114, 116 to move across the tapered sections of the element system 128. As the back-up ring members 114, 116 move axially, the element system 128 expands radially from the body 112 to engage the surrounding tubular. The compressive forces cause the wedges forming the back-up ring members 114, 116 to pivot and/or rotate to fill any gaps or voids therebetween and the element system 128 is compressed and expanded radially to seal the annulus formed between the body 112 and the surrounding tubular. The axial movement of the components about the body 112 applies a collapse load on the lock rings 130, 134. The lock rings 130, 134 bite into the softer body 112 and help prevent slippage of the element system 128 once activated.

Where a wellbore penetrates two or more hydrocarbon bearing intervals, the setting of one or more tools 100 between each of the intervals can prevent bi-directional fluid communication through the wellbore, permitting operations such as testing, perforating, and fracturing single or multiple intervals within the wellbore without adversely impacting or affecting the stability of other intervals within the wellbore. To restore full fluid communication throughout the wellbore, the one or more sealing members 200 within the wellbore must be dissolved, fractured or otherwise removed and/or breached.

Where the sealing members 200 are fabricated of a soluble material, fluid communication through the wellbore can be restored by circulating an appropriate solvent through the casing string to degrade and/or decompose the soluble sealing members. All of the soluble sealing members 200 within a single wellbore can be fabricated from the same materials (i.e. soluble in the same solvent) or fabricated from dissimilar materials (i.e. one or more disks soluble in a first solvent and one or more disks soluble in a second solvent). For example, one or more sealing members 200 soluble in a first solvent can be disposed in an upper portion of the wellbore, while one or more sealing members 200 soluble in a second solvent can be disposed in a lower portion of the wellbore. The circulation of the first solvent can dissolve the sealing member(s) 200 in the upper portion of the wellbore thereby restoring fluid communication in the upper portion of the wellbore. The circulation of the first solvent will not affect the sealing members in the lower portion of the wellbore since the sealing members 200 in the lower portion are insoluble in the first solvent. Full fluid communication throughout the wellbore can be restored by circulating the second solvent in the wellbore, thereby dissolving the sealing members 200 in the lower portion of the wellbore.

Where one or more frangible sealing members 200 are disposed within the wellbore, a wireline breaker bar can be used to fracture, break, or otherwise remove the sealing member(s) 200. In one or more embodiments, a combination of soluble sealing members and frangible sealing members can be used within a single wellbore to permit the selective removal of specific sealing members 200 via the circulation of an appropriate solvent within the wellbore.

Figure 4:
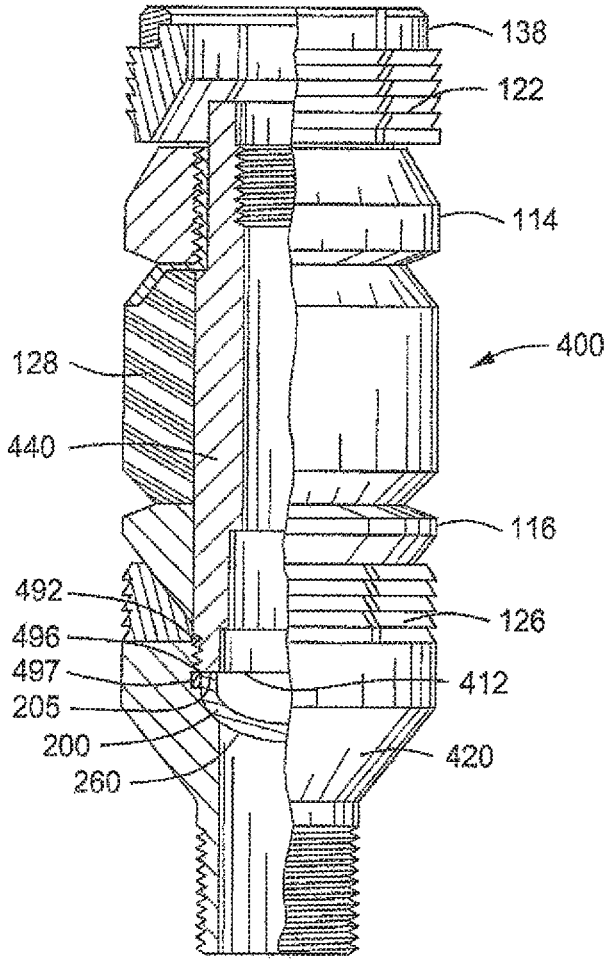
FIG. 4 depicts a partial sectional view of an illustrative bridge plug having one or more sealing members in accordance with one or more embodiments described.

FIG. 4 depicts a partial sectional view of an illustrative bridge plug 400 having one or more sealing members 200 in accordance with one or more embodiments. The plug 400 can include a lower-sub 420 and an upper-sub 440. In one or more embodiments, one or more sealing members 200 can be disposed within the lower-sub 420. The anchoring system 170 can be disposed about an outer surface of the upper-sub 440. The second (upper) end of the lower-sub 420 and first (lower) end of the upper-sub 440 can be threadedly interconnected. In one or more embodiments, both the lower-sub 420 and the upper-sub 440 can be constructed from metallic materials including, but not limited to, carbon steel alloys, stainless steel alloys, cast iron, ductile iron and the like. In one or more embodiments, the lower-sub 420 and the upper-sub 440 can be constructed from non-metallic composite materials including, but not limited to, engineered plastics, carbon fiber, and the like. The tool 400 can include one or more metallic and one or more non-metallic components. For example, the lower-sub 420 can be fabricated from a non-metallic, engineered, plastic material such as carbon fiber, while the upper-sub 440 can be fabricated from a metallic alloy such as carbon steel.

In one or more embodiments, the first, lower, end of the upper-sub 440 can include a seating surface 412 for the sealing member 200. In one or more embodiments, a groove 496 with one or more circumferential sealing devices ("elastomeric sealing elements") 497 disposed therein can be disposed about an inner circumference of the second, upper, end of the lower-sub 420. The end 205 of the first, downwardly facing, sealing member 200 can be disposed proximate to the seating surface 412. The second end of the lower-sub 420 can be threadably connected using threads 492 to the first end of the upper-sub 440, trapping the first sealing member 200 therebetween. The one or more elastomeric sealing elements 497 with the lower-sub 420 can be disposed proximate to the base 230 of the first sealing member 200, forming a liquid-tight seal therebetween and preventing fluid communication through the bore of the tool 400.

In one or more embodiments, the one or more elastomeric sealing elements 497 can be fabricated from any resilient material unaffected by downhole stimulation and/or production fluids. Such fluids can include, but are not limited to, frac fluids, proppant slurries, drilling muds, hydrocarbons, and the like. For example, the one or more elastomeric sealing elements 497 can be fabricated using one or more materials, including, but not limited to, buna rubber, polytetrafluoroethylene ("PTFE"), ethylene propylene diene monomer ("EPDM"), Viton®, or any combination thereof.

In one or more embodiments, the upper-sub 440 can define a threaded, annular, cross-section permitting threaded attachment of the upper-sub 440 to a casing string (not shown) and/or to other tool sections, for example a lower-sub 420, as depicted in FIG. 4. In one or more embodiments, the sealing member 200 can be concentrically disposed transverse to the longitudinal axis of the tool 400 to prevent bi-directional fluid communication and/or pressure transmission through the tool. In one or more embodiments, the lower-sub 420 can define a threaded, annular, cross-section permitting threaded attachment of the lower-sub 420 to a casing string (not shown) and/or to other tool sections, for example a upper-sub 440, as depicted in FIG. 4.

Figure 5:
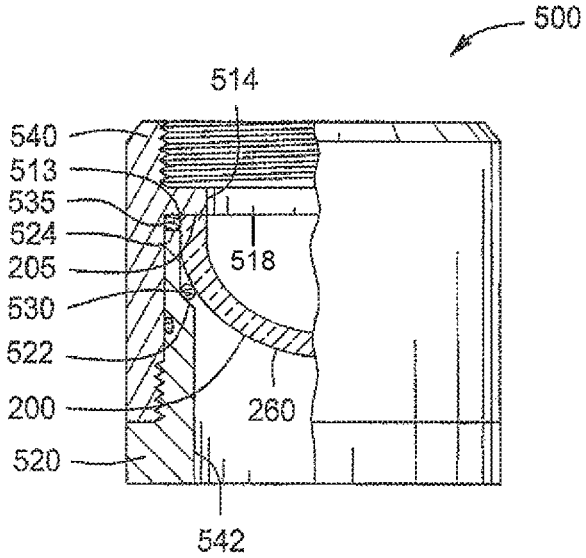
FIG. 5 depicts an enlarged partial sectional view of another bridge plug having one or more sealing members in accordance with one or more embodiments described.

FIG. 5 depicts an enlarged partial sectional view of another plug 500 having one or more sealing members 200 in accordance with one or more embodiments. In one or more embodiments, a lower-sub 520 and an upper-sub 540 be threadably connected, trapping a sealing member 200 therebetween. The lower-sub 520 can have a second (upper) end 524 and a shoulder 522 disposed about an inner circumference. The upper-sub 540 can have a shoulder 514 disposed about an inner diameter of the body 540 having a sealing member seating surface ("first sealing surface") 513 on a first, lower, side thereof. The end 205 of the first, downwardly facing, sealing member 200 can be disposed proximate to the first sealing surface 513.

A circumferential sealing device ("first elastomeric sealing element") 535 can be disposed about the base 230 of the first sealing member 200, proximate to the body 540. A circumferential sealing device ("second elastomeric sealing element") 530 can be disposed about a circumference of the curved surface 260 of the first sealing member 200. As the lower-sub 520 is threadably connected to the body 540 the second, upper, end 524 of the lower sub 520 compresses the first elastomeric sealing element 535, forming a liquid-tight seal between the sealing member 200, the body 540 and the lower-sub 520. The shoulder 522 disposed about the inner circumference of the lower-sub 520 compresses the second elastomeric sealing element 530 between the surface 260 of the sealing member 200 and the shoulder 522, forming a liquid-tight seal therebetween. The pressure exerted by the lower-sub 520 on the sealing member 200 causes the end 205 of the sealing member 200 to seat against the first sealing surface 513.

In one or more embodiments, the first and second elastomeric sealing elements, 530, 535 can be fabricated from any resilient material unaffected by downhole stimulation and/or production fluids. Such fluids can include, but are not limited to, frac fluids, proppant slurries, drilling muds, hydrocarbons, and the like. For example, the first and second elastomeric sealing elements, 530, 535 can be fabricated using the same or different materials, including, but not limited to, buna rubber, polytetrafluoroethylene ("PTFE"), ethylene propylene diene monomer ("EPDM"), Viton®, or any combination thereof.

In operation, the plug 400 can be set in the wellbore in similar fashion to the plug 100. To set or activate the plug 400, the body 440 can be held by the wireline, through the inner portion of the setting tool, while an axial force can be applied through a setting tool to the support ring 138. The axial force causes the outer portions of the plug 400 to move axially relative to the body 440. The downward axial force asserted against the support ring 138 and the upward axial force on the body 440 translates the forces to the moveable disposed slip members 122, 126 and back up ring members 114, 116. The slip members 122, 126 are displaced up and across the tapered surfaces of the backup ring members 114, 116 and contact an inner surface of a surrounding tubular. The axial and radial forces applied to the slip members 122, 126 can cause slip members 122, 126 to fracture along pre-cut grooves on the surface of the slip members 122, 126 permitting the serrations or teeth of the slip members 122, 126 to firmly engage the inner surface of the surrounding tubular.

The opposing forces cause the back-up ring members 114, 116 to move across the tapered sections of the element system 128. As the back-up ring members 114, 116 move axially, the element system 128 expands radially from the body 440 to engage the surrounding tubular. The compressive forces cause the wedges forming the back-up ring members 114, 116 to pivot and/or rotate to fill any gaps or voids therebetween and the element system 128 is compressed and expanded radially to seal the annulus formed between the body 112 and the surrounding tubular.

The removal of the one or more sealing elements 200 from the plugs 400, 500 can be accomplished in a manner similar to the tool 100. Where one or more soluble sealing members 200 are used, fluid communication through the wellbore can be restored by circulating an appropriate solvent through the wellbore to degrade and/or decompose the one or more soluble sealing members 200. Similar to the operation of the tool depicted in FIG. 1, the sealing members 200 disposed within tools 400, 500 in the wellbore can be soluble in a common solvent, permitting the removal of all sealing members 200 within the wellbore by circulating a single solvent through the wellbore. Alternatively, the sealing members 200 disposed within tools 400, 500 in the wellbore can be soluble in two or more solvents, permitting the selective removal of one or more sealing members 200 based upon the solvent circulated through the wellbore. Where one or more frangible sealing members are used within tools 400, 500 in the wellbore, fluid communication can be restored by fracturing, drilling or milling the one or more sealing elements 200.

Figure 6:
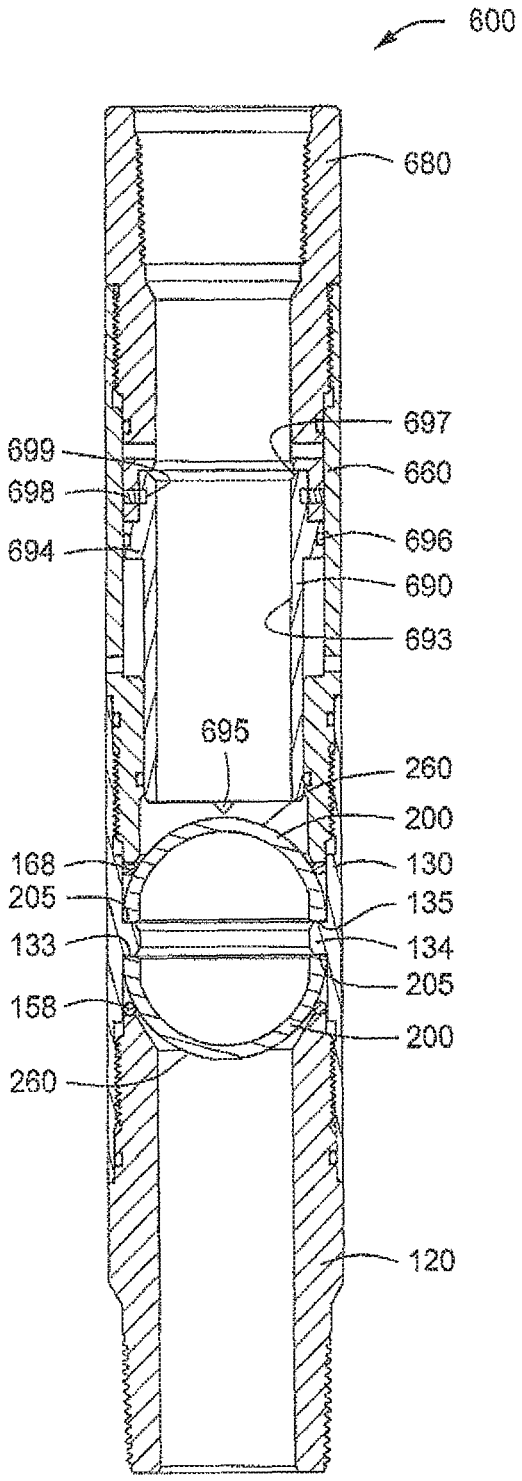
FIG. 6 depicts a partial sectional view of another illustrative tool having one or more sealing members in accordance with one or more embodiments described.

FIG. 6 depicts a partial sectional view of another illustrative tool 600 having one or more sealing members 200 in accordance with one or more embodiments. In one or more embodiments, the tool 600 can have a tool body 660 threadedly connected to an upper-sub 680 having one or more sliding sleeves 690 disposed concentrically therein, a valve housing 130 with one or more frangible sealing members 200 (two are shown) disposed therein, and a lower sub 120. Similar to FIG. 1, the sealing members 200 can be disposed transverse to the longitudinal centerline of the tool 660 with the edge 205 disposed proximate to the shoulder 134. The base 205 of the downwardly facing sealing member ("first sealing member") 200 can be disposed proximate to, and in contact with, a sealing member seating surface ("first sealing surface") 133 of the shoulder 134. The base 205 of the upwardly facing sealing member ("second sealing member") 200 can be disposed proximate to, and in contact with, a sealing member seating surface ("second sealing surface") 135 of the shoulder 134.

A first circumferential sealing device ("first crush seal") 158 can be disposed about the curved surface 260 of the first sealing member 200, to provide a fluid-tight seal between the first sealing member 200, lower-sub 120, and valve housing 130 when the lower-sub 120 is threadedly connected to the valve housing 130. The pressure exerted by the lower-sub 120 on the sealing member 200 causes the end 205 of the sealing member 200 to seat against the first sealing surface 133.

Similarly, a second circumferential sealing device ("second crush seal") 168 can be disposed about the curved surface 260 of the second sealing member 200. As a first (lower) end of the tool body 660 is threadably engaged to a second (upper) end of the valve housing 130, the second crush seal 168 can be compressed between the lower end of the tool body 660, the valve housing 130 and the second sealing member 200, forming a liquid-tight seal therebetween. The pressure exerted by the tool body 660 on the sealing member 200 causes the end 205 of the sealing member 200 to seat against the second sealing surface 135. A first (lower) end of the upper sub 680 can be threadedly connected to a second (upper) end of the tool body 660.

In one or more embodiments, the first and second crush seals, 158, 168 can be fabricated from any resilient material unaffected by downhole stimulation and/or production fluids. Such fluids can include, but are not limited to, frac fluids, proppant slurries, drilling muds, hydrocarbons, and the like. For example, the first and second crush seals 158, 168 can be fabricated from the same or different materials, including, but not limited to, buna rubber, polytetrafluoroethylene ("PTFE"), ethylene propylene diene monomer ("EPDM"), Viton®, or any combination thereof.

In one or more embodiments, the sliding sleeve 690 can be an axially displaceable annular member having an inner surface 693, disposed within the tool body 600. In one or more embodiments, the inner surface 693 of the sliding sleeve 690 can include a first shoulder 697 to provide a profile for receiving an operating element of a conventional design setting tool, commonly known to those of ordinary skill in the art. The sliding sleeve 690 can be temporarily fixed in place within the upper-sub 680 using one or more shear pins 698, each disposed through an aperture on the upper-sub 680, and seated in a mating recess 699 on the outer surface of the sliding sleeve 690, thereby pinning the sliding sleeve 690 to the upper-sub 680. The tool body 660 can be disposed about and threadedly connected to the pinned upper-sub 680 and sliding sleeve 690 assembly, trapping the sliding sleeve 690 concentrically within the bore of the tool body 660 and the upper-sub 680 and providing an open flowpath therethrough.

A shoulder 694, having an outside diameter less than the inside diameter of the tool body 660, can be disposed about an outer circumference of the sliding sleeve 690. In one or more embodiments, the shoulder 694 can have an external, peripheral, circumferential groove and 0-ring seal 696, providing a liquid-tight seal between the sliding sleeve 690 and the tool body 660. In one or more embodiments, the outside surface of the shoulder 694 proximate to the tool body 660 can have a roughness of about 0.1 μm to about 3.5 μm Ra. In one or more embodiments, one or more flame-hardened teeth 695 can be disposed about the first, lower, end of the sliding sleeve 690.

Figure 7:
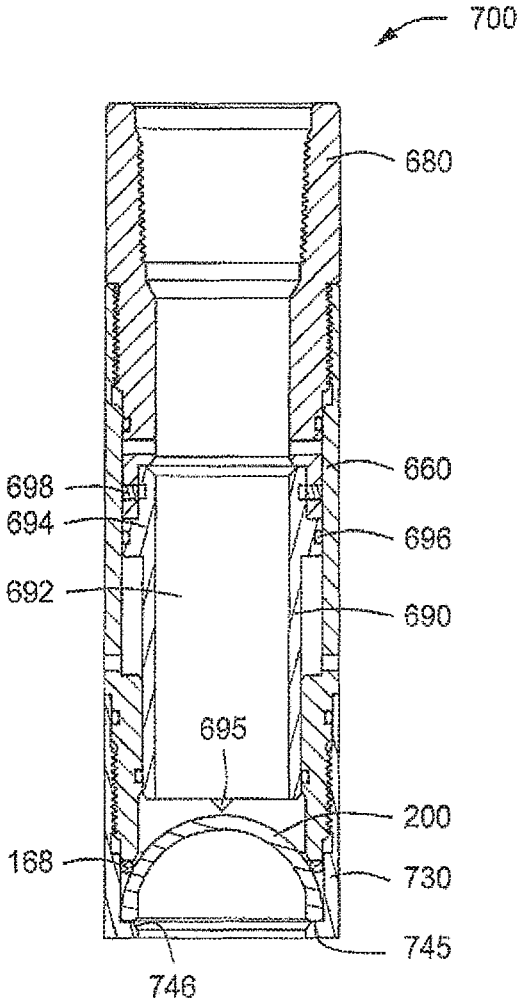
FIG. 7 depicts a partial sectional view of another illustrative downhole tool having one or more sealing members in accordance with one or more embodiments described.

FIG. 7 depicts a partial sectional view of another illustrative downhole tool 700 using an upwardly facing sealing member 200. Similar to the tool 600, the tool 700 can include a tool body 660 threadedly connected to an upper-sub 680 having one or more sliding sleeves 690 disposed concentrically therein, and a valve housing 730 having a shoulder 746 with a sealing member seating surface ("first sealing surface") 745. One or more sealing members 200 can be disposed within the valve housing 730, with the end 205 of the sealing member 200 disposed proximate to, and in contact with, the first sealing surface 745.

Similar to the tool depicted in FIG. 6, a circumferential sealing device ("first crush seal") 168 can be disposed about the curved surface 260 of the second sealing member 200. As a first (lower) end of the tool body 660 is threadably engaged to a second (upper) end of the valve housing 730, the second crush seal 168 can be compressed between the lower end of the tool body 660, the valve housing 730 and the second sealing member 200, forming a liquid-tight seal therebetween. The pressure exerted by the tool body 660 on the sealing member 200 causes the end 205 of the sealing member 200 to seat against the first sealing surface 745. In one or more embodiments, a first (lower) end of the upper sub 680 can be threadedly connected to a second (upper) end of the tool body 660.

In operation of the tools 600, 700, the sliding sleeve 690 within each tool 600, 700 can be fixed in a first position using the one or more shear pins 698 inserted into the one or more recesses 699 disposed about the outer circumference of the sliding sleeve 690. Fixing the sliding sleeve 690 in the first position prior to run-in of the casing string can prevent the one or more teeth 695 from accidentally damaging the sealing members 200 disposed within the tool 600, 700 during run-in. While the sliding sleeve 690 remains fixed in the first position, the one or more sealing members 200 disposed within the tool 600 can prevent bi-directional fluid communication throughout the wellbore.

In one or more embodiments, fluid communication within the wellbore can be restored by axially displacing the sliding sleeve 690 to a second position. The axial displacement should be a sufficient distance to fracture the one or more sealing members 200. In one or more embodiments, through the use of a conventional setting tool, a sufficient force can be exerted on the sliding sleeve 690 to shear the one or more shear pins 698, thereby axially displacing the sliding sleeve 690 from the first ("run-in") position, to the second position wherein the one or more flame hardened teeth 695 ("protrusions") on the first end of the sliding sleeve 690 can impact, penetrate, and fracture the one or more sealing members 200 disposed within the tool 600, 700. The process of axially displacing the sliding sleeve 690 and fracturing the one or more sealing members 200 within each tool 600, 700 disposed along the casing string can be repeated to remove all of the sealing members 200 from the wellbore, thereby restoring fluid communication throughout the wellbore.

Certain embodiments and features have been described using a set of numerical upper limits and a set of numerical lower limits. It should be appreciated that ranges from any lower limit to any upper limit are contemplated unless otherwise indicated. Certain lower limits, upper limits and ranges appear in one or more claims below. All numerical values are "about" or "approximately" the indicated value, and take into account experimental error and variations that would be expected by a person having ordinary skill in the art.

Various terms have been defined above. To the extent a term used in a claim is not defined above, it should be given the broadest definition persons in the pertinent art have given that term as reflected in at least one printed publication or issued patent. Furthermore, all patents, test procedures, and other documents cited in this application are fully incorporated by reference to the extent such disclosure is not inconsistent with this application and for all jurisdictions in which such incorporation is permitted.

While the foregoing is directed to embodiments of the present invention, other and further embodiments of the invention can be devised without departing from the basic scope thereof, and the scope thereof is determined by the claims that follow.

What is claimed is:

1. An assembly for sealing off a bore of a downhole tool, comprising:

a curved surface having an outer face and an inner face, wherein the outer face has a convex configuration and the inner face has a concave configuration, the outer face and the inner face of the curved surface having a distance therebetween;

an annular base depending from the curved surface, the annular base comprising a cylindrical inner surface and a cylindrical outer surface having a distance therebetween, the distance between the cylindrical inner surface and the cylindrical outer surface of the annular base being the same as the distance between the outer face and the inner face of the curved surface; and a first circular seal contacting an exterior surface of the annular base, the first seal configured to form a fluid barrier between at least the annular base and the first seal when the assembly is mounted in a downhole tool.

2. The assembly of claim 1, further comprising a second seal disposed about the outer face of the curved surface.

3. The assembly of claim 2, wherein the first seal is an O-ring, and the second seal is a crush seal.

4. The assembly of claim 1, wherein the outer face of the curved surface comprises a perimeter where the convex configuration ends and a distance between opposing sides of the perimeter, and the annular base has an outer diameter, the outer diameter of the annular base being the same as the distance between the opposing sides of the perimeter such that the annular base is within a perpendicular projection of the perimeter of the curved surface.

5. The assembly of claim 1, wherein the curved surface and the annular base are an integral unit composed of the same material.

6. The assembly of claim 1, further comprising a second seal disposed about the annular base.

7. The assembly of claim 1, wherein the first seal is located adjacent a portion of the annular base distal from the curved surface.

8. The assembly of claim 7, wherein the first seal is compressed by an outer surface of the annular base and an inner wall of the downhole tool when the assembly is mounted in a downhole tool.

9. The assembly of claim 8, wherein the first seal is held in place by a groove.

10. The assembly of claim 1, wherein the first seal is compressed by an outer surface of the annular base and an inner wall of the downhole tool when the assembly is mounted in a downhole tool.

11. The assembly of claim 1, wherein the annular base has a first end proximal the curved surface and a second end distal from the curved surface, and the first seal is located near the first end of the annular base.

12. The assembly of claim 11, wherein the first seal is compressed by an outer surface of the annular base and an inner wall of the downhole tool when the assembly is mounted in a downhole tool.

13. The assembly of claim 12, wherein the first seal is held in place by a groove.

14. An assembly for sealing off a bore of a downhole tool, comprising:

a curved surface having an outer face and an inner face, wherein the outer face has a convex configuration and the inner surface has a concave configuration, the outer face having a perimeter where the convex configuration ends and a distance between opposing sides of the perimeter;

an annular base depending from the perimeter of the outer face, the annular base having an outer diameter and an inner bore, the outer diameter of the annular base being substantially the same as the distance between the opposing sides of the perimeter such that the annular base is within a perpendicular projection of the perimeter of the curved surface; and a first circular seal contacting an exterior surface of the annular base, the first seal configured to form a fluid barrier between at least the annular base and the first seal when mounted in a downhole tool.

15. The assembly of claim 14, further comprising a second seal disposed about the outer face of the curved surface.

16. The assembly of claim 15, wherein the first seal is an O-ring, and the second seal is a crush seal.

17. The assembly of claim 14, wherein the annular base comprises a cylindrical inner surface and a cylindrical outer surface having a distance therebetween, the inner face of the curved surface has a height at its apex, and twice the distance between the cylindrical inner surface and the cylindrical outer surface of the annular base is less than the height of the inner face of the curved surface.

18. The assembly of claim 14, wherein the curved surface and the annular base are an integral unit composed of the same material.

19. The assembly of claim 14, further comprising a second seal disposed about the annular base.

20. The assembly of claim 14, wherein the first seal contacts a portion of the annular base distal from the curved surface.

21. The assembly of claim 20, wherein the first seal is compressed by an outer surface of the annular base and an inner wall of the downhole tool when the assembly is mounted in a downhole tool.

22. The assembly of claim 21, wherein the first seal is held in place by a groove.

23. The assembly of claim 14, wherein the first seal is compressed by an outer surface of the annular base and an inner wall of the downhole tool when the assembly in inserted in a downhole tool.

24. The assembly of claim 14, wherein the annular base has a first end proximal the curved surface and a second end distal from the curved surface, and the first seal is located near the first end of the annular base.

25. The assembly of claim 24, wherein the first seal is compressed by an outer surface of the annular base and an inner wall of the downhole tool when the assembly is mounted in a downhole tool.

26. The assembly of claim 25, wherein the first seal is held in place by a groove.

* * * * *